US010766221B2

(12) United States Patent
Deis et al.

(10) Patent No.: US 10,766,221 B2
(45) Date of Patent: Sep. 8, 2020

(54) METHOD AND DEVICE FOR PRODUCING A CUSHIONING PRODUCT AND CUSHIONING PRODUCT

(71) Applicant: Storopack Hans Reichenecker GmbH, Metzingen (DE)

(72) Inventors: Paul Deis, Preuschdorf (FR); Jean-Marc Slovencik, Uhrwiller (FR)

(73) Assignee: Storopack Hans Reichenecker GmbH, Metzingen (DE)

( * ) Notice: Subject to any disclaimer, the term of this patent is extended or adjusted under 35 U.S.C. 154(b) by 397 days.

(21) Appl. No.: 15/619,090

(22) Filed: Jun. 9, 2017

(65) Prior Publication Data

US 2017/0274615 A1 Sep. 28, 2017

Related U.S. Application Data

(62) Division of application No. 14/100,972, filed on Dec. 9, 2013, now Pat. No. 9,688,044.

(30) Foreign Application Priority Data

Dec. 11, 2012 (DE) ..... 10 2012 222 805

(51) Int. Cl.
*B31D 5/02* (2017.01)
*B31D 5/04* (2017.01)
(Continued)

(52) U.S. Cl.
CPC ..... *B31D 5/04* (2013.01); *B31D 5/0052* (2013.01); *B65D 81/127* (2013.01);
(Continued)

(58) Field of Classification Search
CPC ..... Y10T 428/24198; Y10T 428/24446; Y10T 428/24455; Y10T 428/24463;
(Continued)

(56) References Cited

U.S. PATENT DOCUMENTS 638,361 A * 12/1899 McCool ..... 493/352
2,013,240 A * 9/1935 Harvey ..... B65D 5/48028 217/30

(Continued)

FOREIGN PATENT DOCUMENTS

DE 195 12 716 A1 1/1996
EP 1 539 474 A1 6/2005

OTHER PUBLICATIONS

English Translation of Abstract of DE 19802087, dated Jul. 22, 1989.

(Continued)

*Primary Examiner* — Andrew M Tecco
*Assistant Examiner* — Praachi M Pathak
(74) *Attorney, Agent, or Firm* — Wood Herron & Evans LLP

(57) ABSTRACT

The invention relates to a method for producing a cushioning product (88), comprising the following steps:

providing a flat, longitudinal, two- or multilayered paper strip (10), wherein the individual layers (12, 14) of the paper strip (10) are connected to one another in at least some sections in a middle area (18) extending in the longitudinal direction, and wherein the individual layers (12, 14) of the paper strip (10) comprise marginal areas (20, 21, 22, 23) which are not connected to one another, opening adjacent marginal areas (20, 21, 22, 23) to form a paper strip (10) having a star-shaped cross section, and crumpling the paper strip (10) along the middle area (18).

6 Claims, 4 Drawing Sheets

(51) Int. Cl.
*B31D 5/00* (2017.01)
*B65D 81/127* (2006.01)

(52) U.S. Cl.
CPC ..... *B31D 2205/0023* (2013.01); *B31D 2205/0047* (2013.01); *B31D 2205/0058* (2013.01); *B31D 2205/0064* (2013.01); *B31D 2205/0082* (2013.01); *B65D 2581/053* (2013.01); *Y10T 428/24463* (2015.01)

(58) Field of Classification Search
CPC .. Y10T 428/15; B31D 5/0043; B31D 5/0047; B31D 5/0056; B31D 5/0052; B31D 5/006; B31D 5/0069; B31D 5/02; B31D 2205/0005
USPC ..... 493/350, 352, 379, 407, 904, 464; 206/588, 591–594, 521
See application file for complete search history.

(56) References Cited

U.S. PATENT DOCUMENTS 2,079,374 A * 5/1937 Kent ..... E04B 1/7604 252/62
3,377,224 A 4/1968 Gresham
3,509,798 A 5/1970 Johnson
3,655,500 A * 4/1972 Johnson ..... B31D 5/0047 428/126
3,997,102 A * 12/1976 Jones ..... B65D 5/48028 229/120.26
4,032,179 A 6/1977 Goss
4,272,008 A * 6/1981 Wozniacki ..... B65D 5/48028 229/120.23
4,717,613 A 1/1988 Ottaviano
4,750,896 A 6/1988 Komaransky
4,968,291 A * 11/1990 Baldacci ..... B31D 5/0047 493/350
5,173,352 A * 12/1992 Parker ..... B26D 1/245 428/152
5,387,173 A * 2/1995 Simmons, Jr. ..... B31D 5/0047 493/407
5,558,923 A * 9/1996 Vesamaa ..... B31D 5/006 428/137
5,593,755 A 1/1997 Fuss
5,643,167 A 7/1997 Simmons
5,804,271 A * 9/1998 Barry ..... G09F 3/0289 428/40.1
5,897,926 A 4/1999 Mikulas
5,910,089 A 6/1999 Weder
5,992,637 A 11/1999 Weder
6,035,613 A 3/2000 Lencoski et al.
6,168,560 B1 1/2001 Pluymaekers
6,183,586 B1 2/2001 Heidelberger
6,277,459 B1 * 8/2001 Lencoski ..... B31D 5/0047 206/521
6,534,148 B1 3/2003 Baumuller
6,540,652 B1 4/2003 Ratzel et al.
6,871,480 B1 * 3/2005 Goodrich ..... B31D 3/005 156/207
8,309,194 B2 11/2012 Barredo
8,991,685 B2 * 3/2015 McPeak ..... B65D 5/48028 229/120.22
2001/0042471 A1 * 11/2001 Randazzo ..... B41F 13/085 101/401.1
2002/0109255 A1 8/2002 Weder
2004/0050743 A1 3/2004 Slovencik
2004/0266598 A1 * 12/2004 Toth ..... B31D 5/0047 493/350
2005/0181924 A1 * 8/2005 Demers ..... B26F 3/02 493/350
2006/0247114 A1 * 11/2006 MacCollum Govig ..... B31D 5/006 493/308
2008/0011749 A1 1/2008 Cheich
2009/0082187 A1 3/2009 Cheich et al.
2011/0052875 A1 * 3/2011 Wetsch ..... B31D 5/0052 428/152
2011/0053751 A1 3/2011 Arora
2013/0071613 A1 * 3/2013 Boothman ..... B32B 3/06 428/131
2016/0121574 A1 5/2016 Mirsch

OTHER PUBLICATIONS

English Translation of Abstract of CN101970221 dated Feb. 9, 2011.
English Translation of Abstract of CN201745220, dated Feb. 16, 2011.
English Translation of Abstract of CN102218850, dated Oct. 19, 2011.
Extract German Patent Office Register, corresponding DE Patent Application No. 10 2012 222 805.5, Nov. 6, 2014.
European Patent Office, European Search Report issued in Application No. 13192361.7 dated May 21, 2015.
First Office Action in corresponding Chinese Application No. 201310660937.7, dated Jun. 27, 2016.
English Translation of First Office Action in corresponding Chinese Application No. 20130660937.7, dated Jun. 27, 2016.

* cited by examiner

METHOD AND DEVICE FOR PRODUCING A CUSHIONING PRODUCT AND CUSHIONING PRODUCT

This application is a divisional of U.S. patent application Ser. No. 14/100,972 filed Dec. 9, 2013, which is hereby incorporated by reference herein as if fully set forth in its entirety.

DESCRIPTION

The invention relates to a method and to a device for producing a cushioning product. The invention further relates to a cushioning product as such. The cushioning product is here produced from a flat, longitudinal two- or multilayered paper strip.

From EP 1 539 474 B1, a cushioning product is known which is crumpled from a two-layered paper tube. Also known from the known document are a method and a device by means of which the cushioning product disclosed therein is crumpled from the longitudinal paper tube.

The present invention furthermore aims to provide a method for producing a cushioning product that is particularly suitable for cushioning objects contained in packages.

The aim is achieved by a method having the features of Claim 1.

The method according to the invention comprises the following steps:

- providing a flat, longitudinal, two- or multilayered paper strip, wherein the individual layers of the paper strip are connected to one another in at least some sections in a middle area extending in the longitudinal direction, and wherein the individual layers of the paper strip comprise marginal areas that are not connected to one another,
- opening the paper strip at adjacent marginal areas to form a paper strip having a star-shaped cross section, and
- crumpling the paper strip along the central area.

According to the method of the invention, a flat, longitudinal, two- or multilayered paper strip is thus produced. The individual layers of the paper strip are here connected to one another in at least some sections in the middle area extending in the longitudinal direction. It is conceivable for the connection to be made by positive connection or bonded connection. In particular, it has been found to be particularly advantageous to glue the individual layers in the middle area. Here, the glue connection can extend preferably along a line extending in the longitudinal direction. The glue connection can here be made in just some sections, for example, at some points. However, the glue connection can also be produced along a closed line.

The individual layers of the paper strip moreover do not have mutually connected marginal areas. In the initial state of the paper strip, which can be flat, in particular pressed flat, adjacent marginal areas preferably abut against each other. In a two-layered paper strip whose middle section is connected, four marginal areas are then preferably present, wherein in each case two marginal areas in the flat state then abut against each other. However, it is also possible to provide three or more layers. Then, three or more marginal areas in the flat state are provided which abut against each other. The paper strip, which comprises in particular two layers, is relatively easy to produce. Here, it is conceivable that it is only at the time when the paper strip is provided that the individual layers are connected to one another in the middle area, or that the individual layers are connected to one another in the middle area already before the paper strip is provided, that is in a previous work step, which can also take place at another site.

According to the next process step of the invention, the adjacent, particularly mutually abutting, marginal areas are opened to form a paper strip with a star-shaped cross section. In the case of a two-layered paper strip, a star-shaped paper strip having a total of four protruding "rays" is then produced, wherein said rays are connected in the middle, central area, as before. If three layers are provided, then, in particular, a "star" with six "rays" is formed; if more layers are provided, a "star" having correspondingly more "rays" is formed.

The respective adjacent rays here preferably enclose an angle in the range from 60° to 120° and preferably in the range from 70° to 100°, and furthermore preferably in the range from 85° to 95°.

In the next process step, the paper strip is then crumpled at least along the middle area. The crumpling here occurs in the longitudinal direction at least along the middle area in such a manner that sections of the middle area are moved or shifted toward each other, so that the length of the paper strip in the crumpled state, that is the length of the cushioning product, is shorter than the paper strip in the uncrumpled state. As a result, there is also a greater restoring resilience in the longitudinal direction of the crumpled paper strip in comparison to the uncrumpled paper strip.

The opening of the adjacent marginal area of the paper strip can here occur preferably via one or more opening cores, over which the paper strip is moved. The movement of the paper strip over the opening cores can here occur preferably by means of a machine using a drive. In particular, it is conceivable that, in the middle area of the paper strip, driving rollers seize the paper strip, thereby moving the paper strip.

The crumpling can occur according to the invention with a first set of driving rollers and with a second set of driving rollers in such a manner that the second set of driving rollers rotates at an angular speed which is lower than the angular speed of the first set of driving rollers. By means of such driving rollers, the paper strip can be moved not only over opening cores, but a crumpling along the longitudinal direction in the middle area can also be provided as a result. Depending on how large the difference between the angular speeds of the two sets of driving rollers is, a varying degree of crumpling of the paper strip is possible.

For the respective setting of a specified length of the cushioning product it is advantageous if a separation of the cushioning product into two areas occurs by slowing or stopping the first set of driving rollers, while the second set of driving rollers continues to be driven. Advantageously, the two areas are separated from each other by tearing apart. In this context, it is advantageous if the paper strip comprises predetermined separation places that extend transversely to the longitudinal direction, in particular in the form of perforations.

The mentioned aim is also achieved by a device for producing a cushioning product, in particular for carrying out the method according to the invention, according to the features of Claim 5. Such a device comprises an inlet area for a flat, longitudinal two- or multilayered paper strip. The paper strip as such is here formed in such a manner that the individual layers of the paper strip are connected to one another in at least some sections in a middle area extending in the longitudinal direction, and the individual layers of the paper strip do not comprise mutually connected marginal areas. The device furthermore provides an opening core for opening the paper strip along adjacent marginal areas to form a paper strip with a star-shaped cross section. Moreover, the device provides an advance mechanism for moving the marginal areas over the at least one opening core and a crumpling mechanism for crumpling the paper strip along the middle area. The inlet area, the opening core, the advance mechanism, and the crumpling mechanism are here designed preferably in such a manner that the above-described method according to the invention can be carried out with the device.

Advantageously, the device provides at least two mutually facing opening cores, which are spaced apart from each other in the transverse direction so that the middle area of the paper strip can be moved through, between the opening cores. As a result, the marginal areas of the layers can be opened, so that a star-shaped paper strip is formed. The middle area of the paper strip, in which the individual layers are connected to each other, can nevertheless be moved through, between the opening cores.

Advantageously, the opening cores are designed in such a manner that, in cross section, that is transversely to the longitudinal direction, they comprise wedge sections directed toward each other. As a result, the formation of a paper strip with a star-shaped cross section can be ensured.

Furthermore, it is advantageous for the opening cores to have, in a longitudinal section, that is in the longitudinal direction, wedge-shaped opening sections directed toward the inlet area. By means of these opening sections, an opening of the flat paper strip along adjacent marginal areas can occur in such a manner that the adjacent marginal areas are opened apart from each other, so that in the end a paper strip is formed which has a star-shaped cross section. Opening sections are consequently used to convert the paper strip of flat design into a paper strip which has a star-like shape in cross section.

Here, separating elements, which engage between adjacent marginal sections, can be arranged before the opening cores in the longitudinal direction. The separating elements are consequently used to engage in the adjacent marginal sections, which lie in particular one on top of the other, to ensure then a consistent opening of the marginal areas. The separating elements in particular have a thin and planar design and, moreover, they are spaced from each other in the transverse direction, like the opening cores, so that the middle area of the paper strip, in which the individual layers are connected to one another, can be passed through, between the separating elements. The separating elements can be designed, in particular, as separation disks or metal plates and, moreover, they can be designed to form a single part with the opening cores, particularly at the wedge tips of the opening sections.

Furthermore, it is advantageous if, in the inlet area, a guide roller extending transversely to the longitudinal direction is arranged, over which the flat paper strip is guided. This is advantageous if the paper strip, for example, is rolled off a supply roll or taken from a supply stack.

The advance mechanism for moving the marginal areas over the preferably two opening cores can be formed by a first set of driving rollers. This first set of driving rollers can comprise two rollers arranged one above the other, which seize the paper strip respectively above and below the middle area of the paper strip before the opening wedge in the longitudinal direction. The two rollers can here be arranged in particular in such a manner that they seize the paper strip in the area between the separating elements.

Moreover it is advantageous for the crumpling mechanism to be formed by a second set of driving rollers that work together with the first set of driving rollers, in such a manner that the second set of driving rollers can be rotated at an angular speed that is lower than the angular speed at which the first set of driving rollers can be rotated. As a result, the paper strip can be moved over the first set of driving rollers; a crumpling of the paper strip can be achieved with the second set of driving rollers.

The second set of driving rollers here can comprise two rollers arranged one above the other, which seize the paper strip above and below the middle area of the paper strip in the area between or after the opening wedges in the longitudinal direction. Consequently, it is advantageous if the first set of driving rollers seizes the paper strip in the area before the opening wedge, and the second set of driving rollers seizes the paper strip in the area between or after the opening wedges.

Moreover, it is advantageous if the first set of driving rollers and the second set of driving rollers can be driven in such a manner that, for separating the cushioning product into two areas, the first set of driving rollers can be slowed or stopped, and the second set of driving rollers can continue to be driven. As a result, a separation of the cushioning product by means of the two sets of rollers, which produce a crumpling, can be achieved in a simple manner.

The aim mentioned at the start is also achieved by a cushioning product which can be produced in particular by a method according to the invention and/or in particular by a device according to the invention. Such a cushioning product is produced from a longitudinal, two- or multilayered paper strip, wherein the individual layers are connected to one another in at least some sections in a middle area extending in the longitudinal direction, and wherein the individual layers comprise marginal areas which are not connected to one another, wherein the adjacent marginal areas are opened in the shape of a star, and the paper strip is crumpled at least along the middle area. Such a paper strip can be produced in a simple manner and it nevertheless presents positive cushioning properties.

Additional advantages and advantageous embodiments of the invention can be obtained from the following description in reference to which an embodiment of the example is described and explained in further detail.

Figure 1:
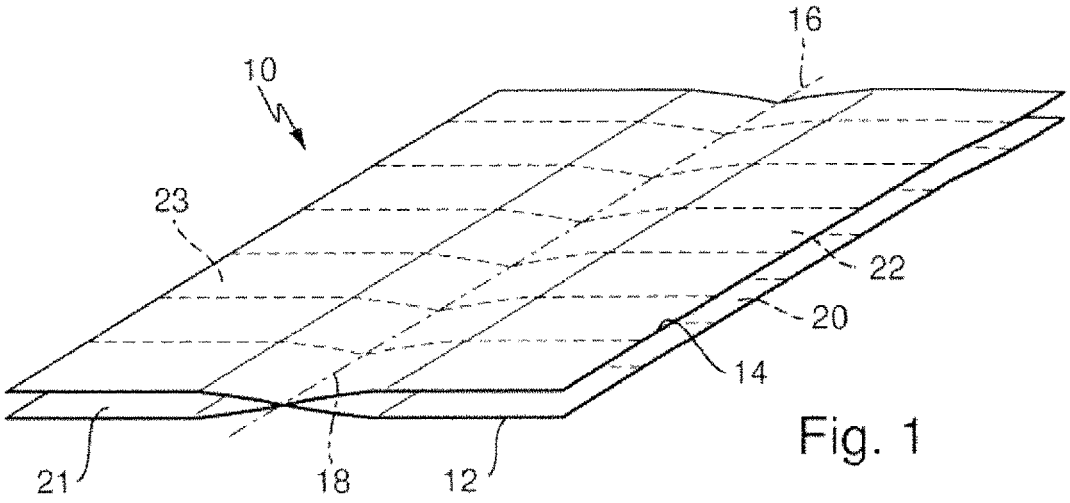
FIG. 1 shows a flat paper strip for producing a cushioning product according to the invention in a perspective view.
Figure 2:
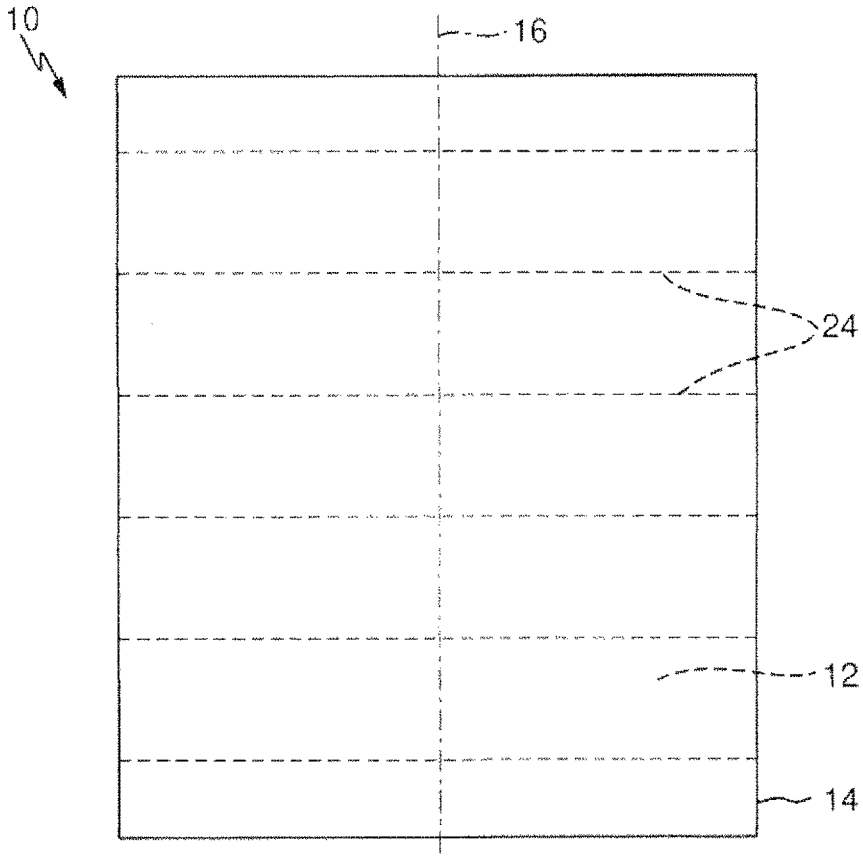
FIG. 2 shows the paper strip according to FIG. 1 in a top view.

The paper strip 10 shown in FIGS. 1 and 2 comprises two layers 12 and 14. The two layers 12, 14 lie on top of each other and have identical outer contours. They have a longitudinal format, wherein their middle longitudinal axis is marked with the reference numeral 16. The paper strip 10 can be an "endless" long paper strip, which can, for example, be unrolled from a roll or removed from a stack.

The two layers 12, 14 are connected to one another in their middle area 18, which extends along the middle longitudinal axis 16 in the paper strip represented in FIGS. 1 and 2. It is preferable for the two layers 12, 14 to be connected to one another by a bonded connection along the middle longitudinal axis 16, in particular by gluing.

The two layers 12, 14 in addition comprise marginal areas 20, 21 and 22, 23 which are not connected to one another. The layer 12 thus comprises the two marginal areas 20, 21. The layer 14 comprises the two marginal areas 22, 23. The marginal area 20 of the layer 12 is here arranged adjacently to the marginal area 22 of the layer 14. Similarly, the marginal area 21 of the layer 12 is arranged adjacently to the marginal area 23 of the layer 14. In the flat state of the paper strip 10, shown in FIGS. 1 and 2, the marginal areas 20 and 22 as well as the marginal areas 21 and 23 can be in mutual contact. These marginal areas 20, 21, 22, 23 are then opened to form rays 26, as described further below.

As is apparent in particular from FIG. 2, the paper strip 10 comprises predetermined separation areas 24 which extend transversely to the longitudinal axis 16 and which are configured as perforations provided in the layers 20 and 22. As a result, the paper strip 10 can be separated into two areas, along a predetermined separation place 24, by tearing off in the longitudinal direction.

Figure 3:
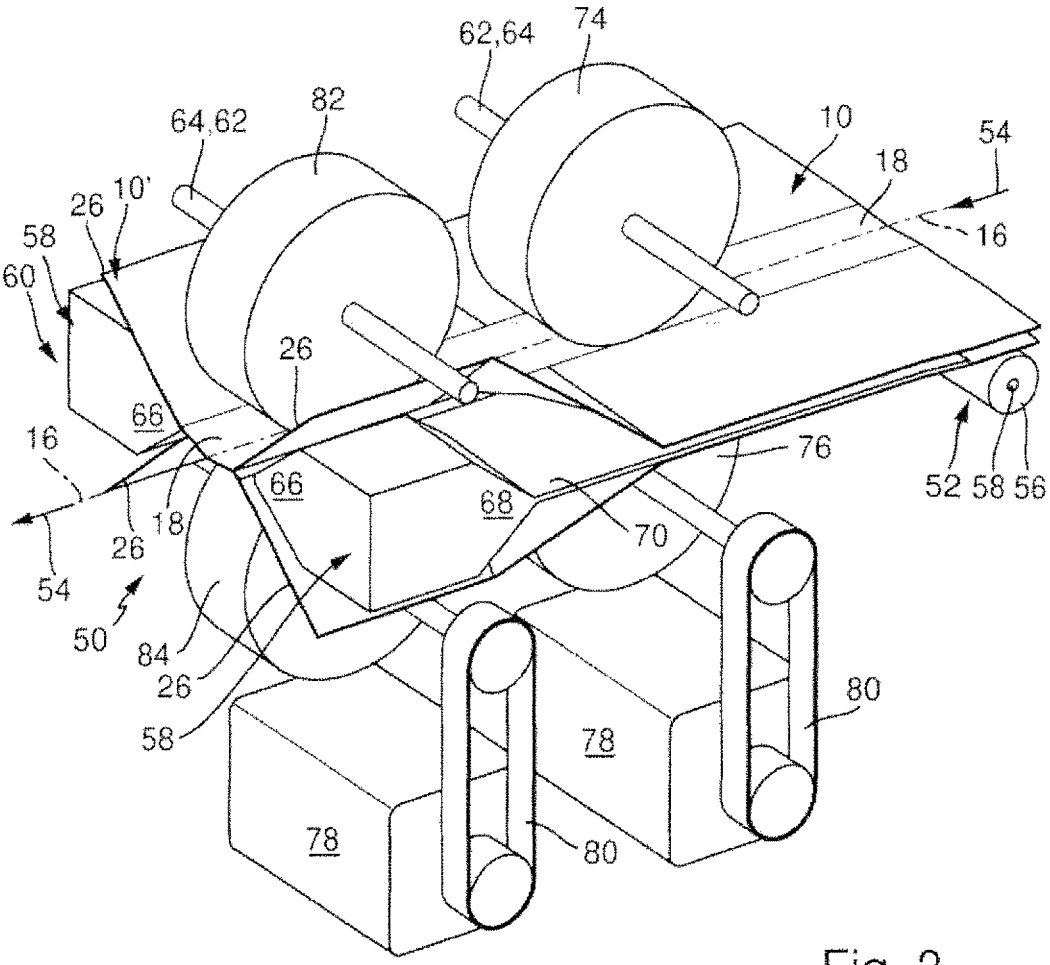
FIG. 3 shows a perspective view of a device according to the invention for producing a cushioning product.

In FIG. 3, the paper strip 10 is represented as it is reshaped to make a cushioning product. For this purpose, the device 50 represented in FIG. 3 is used. The device 50 comprises an inlet area 52, in which a guide roller 56 is provided, which is arranged transversely to the longitudinal direction 54 extending along the middle longitudinal axis 16 of the paper strip 10. The guide roller 56 is here arranged so it can be rotated about a rotation axis 58, in particular in such manner that the endless paper strip 10 is guided over the guide roller 56 during the operation of the device 50.

The device 50 comprises furthermore two opening cores 58 for opening the flat paper strip 10 to form a paper strip 10' which has a star-shaped cross section. The device 50 furthermore comprises an outlet area 60, in which one can clearly see the paper strip 10' which has been opened to the shape of a star.

Furthermore, the device 50 comprises an advance mechanism 62 for moving the paper strip 10 in the device 50 as well as a crumpling mechanism 64 for crumpling the paper strip 10 or 10' along the middle area 18.

Figure 5:
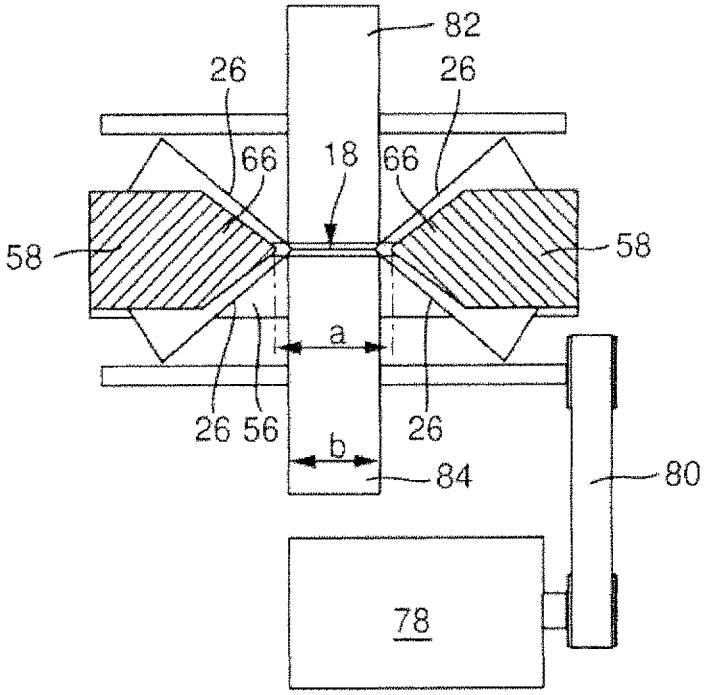
FIG. 5 shows the device according to FIGS. 3 and 4 in cross section along line V in FIG. 4.

As is apparent from FIGS. 3 and 5, the opening cores 58 face one another and they are spaced apart from each other by the distance a in the transverse direction, that is perpendicularly to the longitudinal direction 54. The dimension a is selected here in such a manner that the middle area 18 of the paper strip 10, that is the area in which the two layers 12 and 14 are connected to one another, can be moved through, between the two opening cores 58. It is apparent, particularly from FIG. 5, that the two opening cores 58 comprise wedge sections 66 that are directed toward one another in cross section. The two wedge sections here enclose an angle of approximately 75°.

Figure 4:
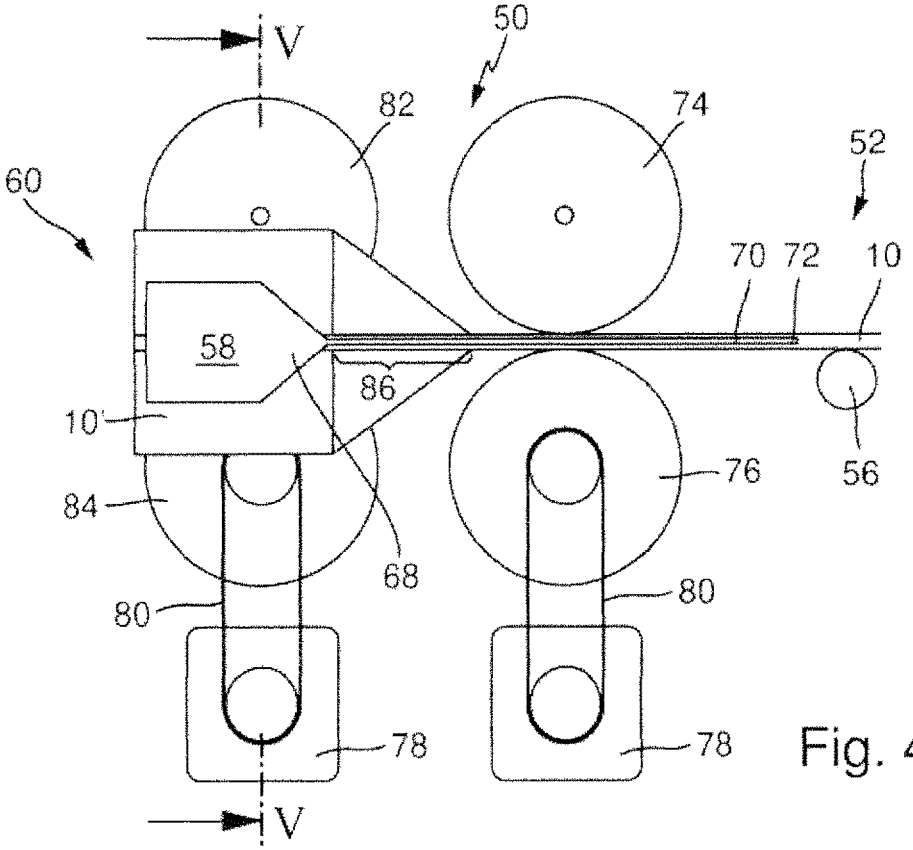
FIG. 4 shows the device according to FIG. 3 in a side view.

Moreover, it is apparent from FIGS. 3 and 4 that the opening cores 58 comprise opening sections 68 configured in the shape of a wedge in longitudinal section toward the inlet area 52. During the operation of the device 50, the paper strip 10 is opened in the marginal areas 20, 21, 22, 23 along the opening section 68.

In order to ensure a reliable opening of the marginal areas 20, 21, 22, 23, separating elements 70, which can be seen particularly clearly in FIGS. 3 and 4, are positioned, against the longitudinal direction 54, before the opening cores 68. The separating elements 70 are designed as metal separation plates, and, in the embodiment example depicted in the figures, they are designed to form a single part with the opening cores 58. At the end areas 72 away from the opening sections 68, the separating elements 70 engage between the mutually adjacent marginal areas 20 and 22, or 21 and 23, of the paper strip 10, so that the marginal areas 20, 21 and 22, 23, during the operation of the device, can be opened reliably by the opening cores 58. The advance mechanism 62 comprises a first set of driving rollers 74, 76, which are shown clearly in FIGS. 3 and 4. The driving rollers 74, 76 are arranged one above the other and they seize the paper strip 10 respectively above and below the middle area 18 of the paper strip 10. In the embodiment according to the figures, the driving roller 76 is driven by a motor 78 via a V-belt 80. The roller 74 is applied at a low pre-tensioning against the roller 76, so that the latter roller is also driven by the roller 76. As mentioned, between the rollers 74 and 76, the middle area 18 of the paper strip 10 is located, as can be seen in FIG. 3.

For crumpling the paper strip 10 along the middle area, a second set of driving rollers 82, 84 is provided, which is arranged after the first set of driving rollers 74, 76 in the longitudinal direction 54. Like the first set of driving rollers 74, 76, in the case of the second set of driving rollers 82 84, the lower roller 84 is also driven via an additional electrical motor 78, in particular via an additional V-belt 80. The upper roller 82 is separated under pre-tensioning against the lower roller 84, so that the latter also rotates when the roller 84 rotates.

As is apparent particularly in FIG. 4, the first set of driving rollers 74, 76 is located, in the longitudinal direction 54, before the opening cores 58, in particular in the area between the two separating elements 70. As one can also see clearly in FIG. 4, the second set of driving rollers 82, 84 is located in the area between the two opening cores 54. From FIG. 5, it becomes apparent that the driving rollers 82, 84 as well as the driving rollers 74, 76 have a width b which is slightly smaller than the separation a between the opening cores 58.

The angular speed of the rollers 82, 84 of the second driving set can here be selected in such a manner that it is slightly lower than the angular speed of the driving rollers 74, 76 of the first set. As a result, a crumpling of the paper strip 10 in the middle area 18 in a crumpling area 86 is produced, wherein the crumpling area 86 is located between the two sets of rollers 74, 76 and 82, 84. The paper strip 10 consequently leaves the device in the outlet area 60 as a cushioning product, which, on the one hand, is opened to the shape of a star, and, on the other hand, is crushed in particular in the middle area. It should be noted that, in FIGS. 3 and 4, the rollers 74, 76 and 82, 84 rotate at the same angular speed, so that the paper strip 10' is not crumpled here. The paper strip 10' which leaves the device 50 consequently comprises the middle area 18 which is guided through between the rollers 72, 74 and 82, 84. This area 18 is followed by the marginal areas 20, 21, 22, 23 which are opened to the shape of a star by means of the cores 58, that is to say the four "rays" 26 of the opened paper strip 10'. The middle area 18 here has a width which corresponds to the width b. It is conceivable to reduce the width b to a very small size, for example, a line. As described, for crumpling, the angular speed of the rollers 74, 76 is increased or that of the rollers 82, 84 is decreased.

As described, such a cushioning product can be produced in a simple manner, while nonetheless having advantageous cushioning properties.

Although, in the figures, a paper strip 10 is represented which has only two layers, it is also conceivable to use a paper strip which has three or more layers. The three or more layers are then connected to one another in the middle area 18, or preferably in the area of the middle longitudinal axis 16. Instead of two mutually facing opening cores 58, advantageously a total of four or more opening cores are then used, which engage in the interstices between the respective adjacent marginal areas of the respective layers.

For separating the endless long paper strip 10 into different areas, it is advantageous to slow the first set of driving rollers 74, 76, while the second set of driving rollers 82, 84 continues to be driven, so that a tearing off occurs along a predetermined separation area represented in FIGS. 1 and 2.

Figure 6:
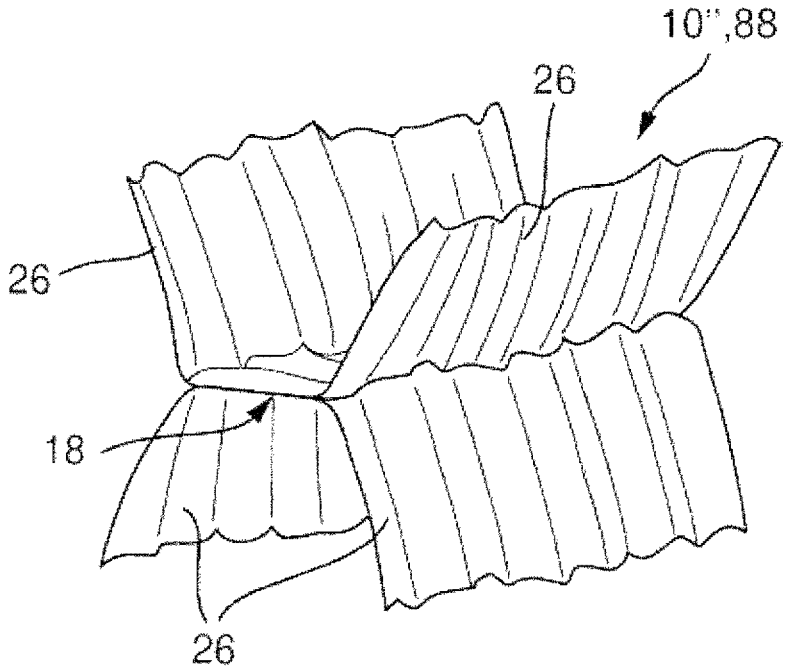
FIG. 6 shows a cushioning device according to the invention.

In FIG. 6, a crumpled paper strip 10" produced by the device 50, that is to say the finished cushioning product 88, is depicted. One can clearly see the crumpled middle area 18 with its width b, to which the marginal areas 20, 21, 22, 23 or the rays 26 are connected.

The invention claimed is:

1. A cushioning product comprising:

an elongated, longitudinally extending, multi-layered paper strip, said strip having a pair of opposite marginal areas and a middle area between said opposite marginal areas, individual layers of said multi-layered paper strip connected to one another in said middle area in at least some locations along the longitudinal extent of said middle area, individual layers of said multi-layered paper strip not connected to one another in said marginal areas, adjacent ones of the individual layers of said multi-layered paper strip spread away from one another in said marginal areas such that said cushioning product has a longitudinally continuous star-shaped cross-section, the star-shaped cross-section defined as having protruding rays extending from the middle area of the paper strip, wherein the number of rays is based on the number of layers in the paper strip, said middle area of said cushioning product crumpled longitudinally such that for a given length of said multi-layered paper strip, said cushioning product is shorter than the given length of said multi-layered paper strip, wherein said adjacent ones of the individual layers of said multi-layered paper strip at each said marginal area form an included angle therebetween ranging from about 60 degrees to about 120 degrees.

2. The cushioning product of claim 1 wherein said multi-layered paper strip has two layers, thereby producing a star-shaped cross-section having four rays.

3. The cushioning product of claim 1 wherein the individual layers of said multi-layered paper strip are connected to one another in said middle area by an adhesive.

4. The cushioning product of claim 1 wherein said multi-layered paper strip has separation areas, comprising lines of perforations, extending transversely to the longitudinal extent of said paper strip and spaced apart along the longitudinal extent of said paper strip.

5. The cushioning product of claim 1 wherein the included angle ranges from about 70 degrees to about 100 degrees.

6. The cushioning product of claim 1 wherein the included angle ranges from about 80 degrees to about 95 degrees.

* * * * *